United States Patent [19]

Whittle

[11] 4,427,559

[45] Jan. 24, 1984

[54] METHOD OF PREPARING OVERBASED CALCIUM SULFONATES

[75] Inventor: Joanne R. Whittle, Nederland, Tex.

[73] Assignee: Texaco Inc., White Plains, N.Y.

[21] Appl. No.: 228,406

[22] Filed: Jan. 26, 1981

[51] Int. Cl.[3] ..... C10M 1/40

[52] U.S. Cl. ..... 252/33.2; 252/33.4

[58] Field of Search ..... 252/33.2, 33, 33.3; 1/3

[56] References Cited

U.S. PATENT DOCUMENTS 3,384,587 5/1968 Holst et al. ..... 252/33.2

3,524,814 8/1970 Sabol et al. ..... 252/33.2

4,086,170 4/1978 De Clippeleu et al. ..... 252/33

4,206,062 6/1980 Derbyshire et al. ..... 252/33.2

*Primary Examiner*—Jacqueline V. Howard

*Attorney, Agent, or Firm*—Carl G. Ries; Robert A. Kulason; Henry W. Archer

[57] ABSTRACT

In the preparation of overbased calcium sulfonates the use of a mixture of calcium oxide and calcium hydroxide wherein the mole ratio $CaO/CaOH_2+Ca(OH)_2$ ranges from 0.2 to 1.0 improves lime and sulfonate utilization and reduces the amount of solid waste material which must be filtered from the product.

3 Claims, No Drawings

METHOD OF PREPARING OVERBASED CALCIUM SULFONATES

BACKGROUND OF THE INVENTION

1. Field of the Invention

This invention is concerned with an improved method of preparing alkaline earth metal carbonate-overbased alkaline earth metal sulfonates which are useful as detergent and reserve alkalinity lubricating oil additives. More specifically, the object of the present overbasing technique is to obtain a complex or micellar dispersion of calcium carbonate in the presence of a surfactant type material such as a neutral calcium sulfonate.

2. Prior Art

In connection with this invention, the applicant is aware of U.S. Pat. Nos. 3,524,814; 3,878,116 and 4,086,170.

The prior art for overbasing calcium sulfonates employs either calcium hydroxide or calcium oxide but not a combination of the two as the inorganic calcium source. When calcium hydroxide is used as the sole inorganic source, a large volume of solids remain after the overbasing is complete and these solids must be removed by filtration or centrifugation. A reduction in the solids content of the crude product improves process economics and reduces solid waste disposal problems. The processes employing calcium oxide as the sole inorganic calcium source require the use of an additional ingredient; a promoter, such as an amine or ammonia (U.S. Pat. No. 4,086,170) or overbasing in stages with solvent removal, water treatment and dehydration steps after each stage (U.S. Pat. No. 3,878,116).

SUMMARY OF THE INVENTION

In accordance with the present invention, alkaline earth calcium sulfonates derived from natural or synthetic feedstocks or a mixture of both can be overbased by introducing into a mixture comprising a neutral alkaline earth metal sulfonate, alkaline earth metal oxide, alkaline earth hydroxide, a lower alcohol and a light hydrocarbon diluent, a super stoichiometric, stoichiometric or substoichiometric amount of carbon dioxide.

It has been found that the use of a mixture of calcium hydroxide and calcium oxide is particularly advantageous in that the solids content of the crude product can be reduced and the use of a promoter or overbasing in stages can be eliminated. The mole ratio of calcium hydroxide to calcium oxide is critical if a bright and clear oil soluble product is to be produced. The data indicate that calcium hydroxide and calcium oxide are not interchangeable as implied in some previous patents. The process produces alkaline earth metal carbonaceous overbased alkaline earth sulfonates, particularly calcium sulfonates having a total base number (TBN) of 400 and over.

A key feature of the present process is the use of a molar ratio of oxide to moles of oxide and hydroxide ranging from 0.2 to 1.0.

The operating parameters of the present process are tabulated below in Table I.

TABLE I

| Variable | Operable Range | Preferred Range |
|---|---|---|
| 1. Reaction temperature | 100–170 F. | 130–150 F. |
| 2. Pressure, psig | 0–50 | 0–20 |

TABLE I-continued

| Variable | Operable Range | Preferred Range |
|---|---|---|
| 3. Mole ratio: $CaO/CaO + Ca(OH)_2$ | 0.2–1.0 | 0.2–0.3<br>0.6–0.7 |
| 4. Mole ratio: $CO_2/CaO + Ca(OH)_2$ | 0.1–1.2 | 0.7–1.2 |
| 5. Mole ratio: Alcohol/$CaO + Ca(OH)_2$ | 0.5–3.0 | 0.75–1.9 |
| 6. Wt ratio: hydrocarbon solvent/neutral calcium sulfonate | 1.0–2.0 | 1.25–1.75 |

Examples of useful and preferred reactants which may be employed in the practice of this invention are given below in Table II.

TABLE II

| Reactants | Example | Preferred Reactant(s) |
|---|---|---|
| 1. Calcium oxide | | One with a total slaking time of 6–24 min and a temperature rise of 6° C. max in the first 30 sec. as measured by ASTM C-100-76a. |
| 2. Calcium Hydroxide | | One derived from the above type of calcium oxide. |
| 3. Calcium Sulfonate | Neutralized "sulfonic acid" derived from a natural feedstock. Neutralized "sulfonic acid" derived from a synthetic feedstock. Blends of neutralized sulfonic acids from natural and synthetic feedstocks. | Blends of neutralized sulfonic acids from natural and synthetic feedstocks. |
| 4. Diluent Oil | 100–500 SUS (100 F.) pale stock. 100–500 SUS (100 F.) solvent neutral oil. | 100 SUS pale stock hydro-finished. |
| 5. Hydrocarbon Solvent | Straight run gasoline, dehexanized raffinate, gasoline, normal or mixed hexanes, normal or mixed heptanes, benzene or toluene. | Dehexanized raffinate gasoline. |
| 6. Lower Alcohols | $C_1$–$C_5$ normal or branched chain alcohol. | Methanol. |

EXAMPLES

The invention is further illustrated in nonlimiting fashion by the following examples:

EXAMPLE 1

Calcium sulfonate (45 wt% active) (14 pounds) was diluted with a light hydrocarbon solvent (23 pounds) and methanol (4 pounds). To the diluted mixture was added calcium hydroxide (8.2 lbs) and calcium oxide (2.6 lbs). The mixture was stirred and heated to 140° F. and then gaseous carbon dioxide (5.5 lbs) was introduced into the mixture at a rate of 0.03 lbs/min. A 100–500 SUS (100° F.) diluent oil (9.5 lbs) was then added. The crude reaction mixture contained 26 vol% solids. The mixture was then filtered through diatomaceous earth and the filtrate heated to 250° F. to remove the solvent. The solvent-free filtrate (37.3 lbs) was bright and clear and had a TBN of 400, a calcium sulfonate content of 16.1%, and a Kin Vis 100° C. of 37.5 cSt.

The sulfonate utilization was 94.3% and the "lime" utilization was 84.0%.

A motor oil formulated with an overbased calcium sulfonate prepared as per the above example gave an average rust rating of 8.51 (vs 8.5 min for APISF quality) in the Oils Sequence II D test. This test is described in detail in ASTM Special Technical Publication (STP) No. 315 H.

EXAMPLE 2

Calcium sulfonate (45 wt% active; 15.9 lbs) was diluted with a light hydrocarbon solvent (26.2 lbs) and methanol (4.6 lbs). To the diluted mixture was added calcium hydroxide (3.5 lbs) and calcium oxide (6.2 lbs). The mixture was stirred and heated to 140° F. and then gaseous carbon dioxide (6.3 lbs) was introduced into the mixture at a rate of 0.03 lbs/min. A 100–500 SUS (100° F.) diluent oil (7.19 lbs) was then added. The crude reaction mixture containing 1.7 vol% solids was then filtered through diatomaceous earth and the filtrate heated to 250° F. to remove solvent. The solvent free filtrate (40.1 lbs) had a TBN of 400, a calcium sulfonate content of 17.3% and a Kin Vis 100° C. of 21 cSt. The sulfonate utilization was 96.3% and the lime utilization was 89.9%.

EXAMPLES 3–15

The results of a series of examples tabulated in Table III following, illustrates the results of various mole ratios of calcium oxide to calcium hydroxide. The procedure used in each example is similar to that used in Example 1.

TABLE III

| MOLE RATIOS $\frac{CaO}{CaO + Ca(OH)_2}$ | $\frac{CaO + Ca(OH)_2}{\text{Calcium Sulf}}$ | $\frac{CO_2}{CaO + Ca(OH)_2}$ | Vol % Solids Prior to Filt. | Lime Utilization % | Calcium Sulf. Utilization % | Product Appearance |
|---|---|---|---|---|---|---|
| 3. 0 | 26.7 | 0.80 | 40.9 | 73.7 | 86.5 | Bright Clear Fluid |
| 4. 0.20 | 24.9 | 0.80 | 30.5 | 82.0 | 93.5 | " |
| 5. 0.30 | 24.8 | 0.80 | 26.4 | 84.3 | 94.3 | " |
| 6. 0.40 | 24.8 | 0.80 | 23.8 | 81.6 | 93.8 | Bright Clear Viscous |
| 7. 0.50 | 20.9 | 0.80 | 13.4 | 84.4 | 88.9 | Bright Clear Gel |
| 8. 0.60 | 22.2 | 0.79 | 16 | 85.8 | 95.2 | Crystalline |
| 9. 0.60 | 22.2 | 1.00 | 0.6 | 91.7 | 95.1 | Sl. Haze, Very Fluid |
| 10. 0.70 | 22.1 | 0.80 | 12.5 | 84.0 | 99.6 | Crystalline |
| 11. 0.70 | 22.1 | 0.90 | 1.7 | 89.9 | 96.3 | Sl. Haze, Very Fluid |
| 12. 0.80 | 29.2 | 0.67 | 16.5 | 57.5 | 78.3 | Crystalline |
| 13. 0.80 | 29.2 | 0.99 | 9.2 | 59.3 | 95 | Sl. Haze, Very Fluid |
| 14. 0.90 | 28.8 | 1.00 | 12.0 | 53.7 | 100 | " |
| 15. 1.00 | 22.2 | 0.99 | 9.0 | 55.5 | 96.0 | Sl. Haze, Fluid |

Unexpectedly it has been found that the range of the alkaline earth metal oxide reactivity to water as measured by ASTM C-11a–76a (the disclosure of which is hereby incorporated by reference) is an important feature of the present process. More specifically, calcium oxides with a temperature rise of 6° C. maximum in 30 seconds and with a total slaking time of 6–24 minutes result in much faster filtering products than when higher reactive calcium oxides with temperature rises of 12–39 C in 30 seconds and a total slaking time of 1–4 minutes are used and therefor are preferred in the practise of the invention.

The alkaline earth metal sulfonate employed can be made by sulfonation of solvent refined lubricating oil, using oleum as described in U.S. Pat. No. 2,689,221, or by sulfur trioxide or can be made by sulfonation of a benzene alkylate, preferably in the presence of an inert solvent such as hexane. Preferably, the alkaline earth sulfonates are the alkaline earth metal salts (calcium, barium, magnesium, etc.) of preferentially oil-soluble sulfonic acids ($RSO_3H$). Many usable oil-soluble sulfonic acids and their salts are described in U.S. Pat. Nos. 2,616,404; 2,626,207 and 2,767,209.

Where the alkaline earth metal oxide used is CaO it has been observed, unpredictably, that the ratio of CaO to $Ca(OH)_2$ is critical: up to 30% CaO, satisfactory products are obtained; 30–50% CaO results in a gelatinous material which plugs the filter; above 70% CaO the product is again fluid but contains finely divided particles which cannot be filtered out and result in a "bloom" in reflected light. Although use of either CaO or $Ca(OH)_2$ has been discussed in prior patents on overbased calcium sulfonate manufacture, it is not believed that the advantage of using mixtures or the criticality of the ratio of the two has been recognized previously.

Among the advantages of the present process are that the same improves the line and sulfonate utilization and the lime and sulfonate significantly reduces the amount of solid waste material which must be filtered from the additive. Notably, a 25 percent increase in capacity can be realized by use of the mixture.

The subject alkaline earth metal carbonate-overbased alkaline earth metal sulfonates, particularly calcium carbonate-overbased calcium sulfonate, can be blended in any desired oil of lubricating viscosity to impart thereto detergency and alkaline reserve properties. Such oil may also contain any of the conventional lube oil additives in an amount sufficient for their intended purposes. Generally, the product of the present process will be incorporated in such oils in an effective amount ranging from about 35 to about 80 weight percent of the oil for a concentrate and in an amount from about 0.1 to 20 weight percent based on the amount of neat oil for an oil formulation.

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. A process for preparing a micellar dispersion of calcium carbonate-overbased calcium sultonate of high alkalinity which consists essentially of the steps of:

(a) mixing a neutral calcium sulfonate with a light hydrocarbon solvent and a lower alkanol;

(b) adding to the resulting mixture (1) a calcium oxide having a temperature rise of about 6° C. maximum in 30 seconds and a total slaking time of about 6 to 24 minutes, and (2) calcium hydroxide in a molar ratio of oxide to hydroxide and oxide ranging from about 0.2 to 1.0, with the ratio of oxide to hydroxide not exceeding 30%; the molar ratio of said alkanol to the sum of the moles of oxide and hydroxide ranging from about 0.5 to about 3.0; and the molar ratio of said hydrocarbon solvent to said neutral calcium sulfonate ranging from about 1.0 to 2.0;

(c) heating the resulting reaction mass to between about 100° F. and 170° F. under a pressure ranging from about 0 to 50 psig;

(d) introducing into the heated mixture gaseous hydrocarbon dioxide in an amount sufficient to provide a molar ratio of $CO_2$ to said oxide and said hydroxide ranging from about 0.1 to 1.2;

(e) adding to the thus treated mass a diluent oil;

(f) separating the solids from the liquid in said mass; and (g) heating said liquid to remove said solvent.

2. Calcium carbonate-overbased calcium sulfonates obtained by the process of claim 1.

3. A lubricating composition containing a major amount of an oil of lubricating viscosity and a minor, effective dispersive amount of a calcium carbonate-overbased calcium sulfonate obtained by the process of claim 1.

* * * * *